US008959794B2

(12) United States Patent
Graeff

(10) Patent No.: US 8,959,794 B2
(45) Date of Patent: Feb. 24, 2015

(54) PROCESS AND APPARATUS TO CONTROL THE AIRFLOW IN DEHUMIDIFYING DRYERS

(71) Applicant: Roderich W. Graeff, Palm Springs, CA (US)

(72) Inventor: Roderich W. Graeff, Palm Springs, CA (US)

( * ) Notice: Subject to any disclaimer, the term of this patent is extended or adjusted under 35 U.S.C. 154(b) by 288 days.

(21) Appl. No.: 13/653,784

(22) Filed: Oct. 17, 2012

(65) Prior Publication Data

US 2013/0091723 A1 Apr. 18, 2013

Related U.S. Application Data

(60) Provisional application No. 61/548,485, filed on Oct. 18, 2011.

(51) Int. Cl.

| | |
|---|---|
| ***F26B 21/12*** | (2006.01) |
| ***F26B 21/10*** | (2006.01) |
| ***F26B 21/08*** | (2006.01) |
| ***F26B 25/02*** | (2006.01) |

(52) U.S. Cl.

CPC ..... *F26B 21/083* (2013.01); *F26B 25/02* (2013.01); *F26B 2200/08* (2013.01)

USPC ..... 34/531; 34/572; 34/486; 34/495

(58) Field of Classification Search

CPC ..... F26B 21/10; F26B 21/12; F26B 21/083; F26B 25/22; F26B 25/02; F26B 2200/08; D06F 2058/2877; D06F 2058/288

USPC ..... 34/524, 526, 527, 531, 546, 547, 549, 34/554, 562, 569, 572, 563, 575, 486, 34/495; 318/471, 472, 799, 779, 430–437, 318/268, 445, 450, 452, 461–465, 484

See application file for complete search history.

(56) References Cited

U.S. PATENT DOCUMENTS

| | | | | |
|---|---|---|---|---|
| 5,537,761 | A * | 7/1996 | Oh | 34/499 |
| 5,555,645 | A * | 9/1996 | Joslin | 34/572 |
| 5,563,480 | A * | 10/1996 | Okada | 318/400.08 |
| 5,688,305 | A | 11/1997 | Graeff | |
| 5,942,866 | A * | 8/1999 | Hsieh | 318/268 |
| 6,951,065 | B2 | 10/2005 | Graeff | |
| 2002/0109475 | A1 | 8/2002 | Horng et al. | |

FOREIGN PATENT DOCUMENTS

DE 20103438 U1 6/2001

* cited by examiner

*Primary Examiner* — Kenneth Rinehart
*Assistant Examiner* — Tavia Sullens
(74) *Attorney, Agent, or Firm* — Brown & Michaels, PC

(57) ABSTRACT

A control system for dryers in which the rotation speed of the motors are changed through frequent on/off connections to the electric power line. In accordance with the invention this task is solved by interrupting the electric power driving the electric motor for short periods in such a way that the motor does not come to a complete standstill or remains at a constant speed below the maximum speed. The motor power interruption or application is based upon readings of sensors reading dryer parameters other than the actual speed of the motor being controlled.

20 Claims, 3 Drawing Sheets

PROCESS AND APPARATUS TO CONTROL THE AIRFLOW IN DEHUMIDIFYING DRYERS

REFERENCE TO RELATED APPLICATIONS

This application claims one or more inventions which were disclosed in Provisional Application No. 61/548,485, filed Oct. 18, 2011, entitled "Process and apparatus to control the airflow in dehumidifying dryers". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of dehumidifying dryers. More particularly, the invention concerns a process and an apparatus to control the rotation speed of electric motors which are connected to turning devices used in dehumidifying dryers.

2. Description of Related Art

Electric motors are used to drive turning devices, especially blowers and rotors, containing the desiccant, as they are used in adsorption dryers as described in the present inventor's U.S. Pat. Nos. 6,951,065 and 5,688,305, which are incorporated herein by reference.

FIG. 1 (which is FIG. 2 in U.S. Pat. No. 6,951,065) shows such a dryer (2), representing an adsorption or refrigeration dryer. The granulate hopper (1) has a conveyer unit (4) at the top which sucks granulate out of granulate container (5) and lets it drop into granulate hopper (1) whenever level sensor (6) demands it. Dried granulate leaves the granulate hopper via duct (7) to a fabricating machine (3).

Return air leaves the hopper (1) via duct (8), sucked by blower (9) through filter (10), cooler (11) and dryer (2). Dry air from the dryer (2) flows via duct (12) through heater (13), where it is typically heated to 60-200° C., and is introduced into the lower part of the drying hopper (1). The dry air now flows from the lower part of the hopper (1) to the upper part of the hopper through the slowly descending granulate. In this passage, the air heats and dries the granulate. Finally, the air leaves the hopper as relatively cool return air through duct (8).

A return air temperature sensor (14) for measuring the temperature of the return air is located in the return air duct (8) just behind the hopper (1). A granulate temperature sensor (15) for measuring the granulate temperature is located inside the conveying unit (4), or, alternatively may be located (15*a*) in the granulate container (5). Both sensors are connected through the lines (21) (or (21*a*)) and (22) to control device (23), which alternatively controls flapper valve (24), which is located in duct (8), or the rotation speed of dry air blower (9). One or more air flow sensors (35, 36, 37), for example sensor (37) in duct (12) may be provided as might be needed by a given application. It will be understood that these sensors are shown for illustration purposes, and a given dryer controller might include inputs for all of the named sensors, or only one or two of the sensors, or for additional sensors not specifically called out here.

A second blower (90) can be arranged in line (8) before the return air stream enters the dryer (2). Blower (9) is controlled by controller (23) to control the volume of air flow for heating and drying in accordance with the invention, while blower (90) is controlled by controller (23) to regulate the air pressure in the line between blowers (90) and (9).

FIG. 3, which is FIG. 3 from U.S. Pat. No. 6,951,065, shows an adsorption dryer embodiment which uses a honeycomb rotor containing the adsorption medium, a system similar to the one shown in U.S. Pat. No. 5,688,305. The elements which are common with the embodiment of FIG. 1 have the same reference numbers, and will not be separately discussed here.

Blower (9) sucks return air through duct (8) and blows it through duct (25), and through section (26) of slowly rotating rotor (27), where the return air is being dried.

A regeneration blower (28) blows room air through heater (29) and through segment (30) segment (38) of the rotor (27) where the regeneration takes place. The moist regeneration air leaves segment (38) through the duct (39).

In order to improve the energy efficiency of the dryers under various load conditions in an economical way and with a minimum of a temperature increase in the air streams the rotation speed of the motors are changed through frequent on/off connections to the electric power line. In the past, this has been determined through a complicated calculation algorithm as described in the German Utility Patent (Gebrauchsmusterschrift) DE 201 03 438 U1. Such methods are costly in their development and their purchase costs.

Dryers of a given size must be able to dry different amounts of granulate per time. In real life applications the granulate through-put per hour varies as well as its moisture content. In order to solve this task in an economical way with a minimum use of energy, it is possible in accordance with the aforementioned patents to adjust the amount of dry air, of the regeneration air and of the rotation speed of the rotor, containing the desiccant to the drying test to be performed.

These volumes of air can be adjusted by flapper valves. The reduction of the air volume through a flapper valve has a disadvantage that it does not reduce the energy consumption of the electric motor at the same time. In addition it creates a temperature increase in the air stream with a result of lowering the efficiency of the adsorption dryer.

Another possibility to control the air volume is possible by changing the rotation speed of the electric motor through the use of frequency converters which can change the frequency or voltage of the electric power connected to the motor. One disadvantage is the high cost of a frequency converter. But even more important, if a frequency converter reduces the rotation speed of a blower the overall efficiency of the electric motor, the frequency changer and of the blower is being reduced resulting in an increase of the temperature of the air flow being reduced. This has a highly negative effect on the ability of the desiccant to adsorb moisture.

SUMMARY OF THE INVENTION

A control system for dryers in which the rotation speed of the motors are changed through frequent on/off connections to the electric power line. In accordance with the invention this task is solved by interrupting the electric power driving the electric motor for short periods in such a way that the motor does not come to a complete standstill or remains at a constant speed below the maximum speed. The motor power interruption or application is based upon readings of sensors reading dryer parameters other than the actual speed of the motor being controlled.

DETAILED DESCRIPTION OF THE INVENTION

Figure 1:
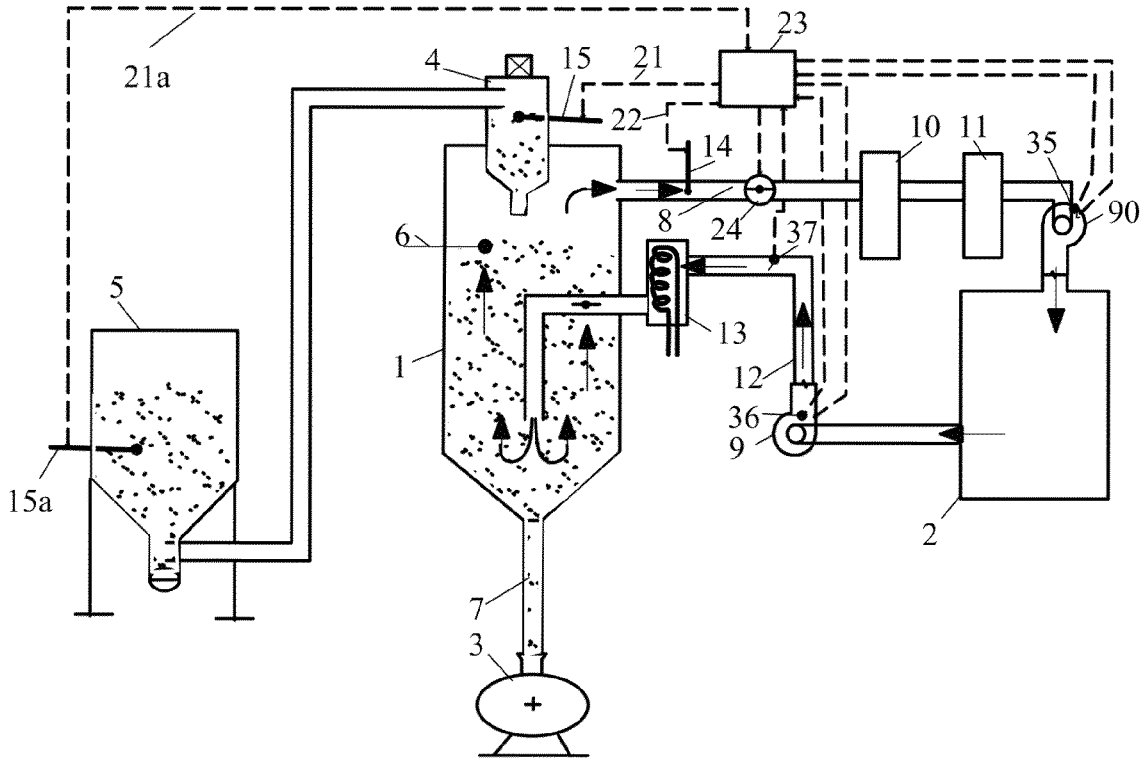
FIG. 1 shows a dryer for use with the method of the invention.

FIG. 1 shows a diagram of a dryer which can be used with the method of the invention. The parts of the dryer will not be separately explained here, but the explanation can be found in the description of FIG. 1 in the description of the related art section above.

The invention adjusts the rotation speed of electrical motors in an economical way, which means low production costs and low energy consumption, and in a way when used in connection with adjusting the amount of the flow of a gas, minimizes the heating of the gas by the energy loss of the control system. In accordance with the invention this task is solved by interrupting the electric power driving the electric motor for short periods in such a way that the motor does not come to a complete standstill, and preferably does not speed up to full speed.

If the motor is used to drive a blower, for instance a centrifugal blower, one can reach a reduction of the volume of the air without great fluctuations. This is important especially when used in adsorption dryers, especially for the dry air stream and the regeneration air stream as both air streams are heated through electric heating elements. These heating elements would be negatively affected if the air stream fluctuates too greatly.

When an electric motor is turned on, the initial electric current gets quite high leading to an overheating of the electric motor. When, in accordance with the invention, the electric motor, connected to a blower, is being turned off so frequently that it does not come to a stand still, these initial electric currents don't get too high as the motor does not have to be accelerated from a standstill position.

When, in accordance with the invention, the duration of the interruptions is only a number of seconds or even only part of a second, then the rotation speed of the electric motor is noticeably reduced, but the power is not interrupted long enough for the motor and load to come to a total standstill. The maximum time for which power delivered to a given motor can be interrupted will be determined empirically by testing the specific motor/load combination being controlled, so that power is not off long enough to let the motor stop. Experiments have shown that with these short interruption periods, the electric motor is actually cooler than when running continuously, as with the reduction of the motor speed the amount of air to be conveyed is also reduced, which lowers the consumption of electric energy.

In accordance with the invention the duration of the interruption of the power supply and its duration is controlled by the input of measuring a physical value, like a temperature at a defined location, as described in the U.S. Pat. No. 6,951,065 and U.S. Pat. No. 5,688,305, which are incorporated herein by reference. These physical set point values are influenced by the effect of the speed control, but not necessarily 100% correlated to the speed, and might fluctuate under the influence of other factors.

Figure 2:
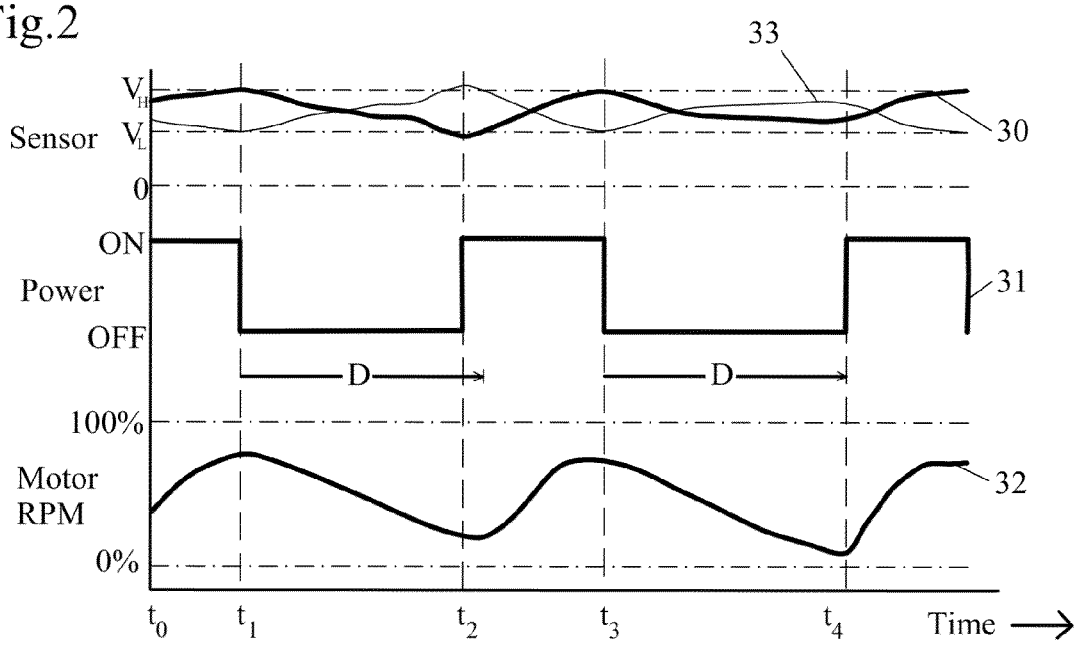
FIG. 2 shows a graph of sensor output, motor power and motor RPM over time in the method of the invention.

FIG. 2 shows a graph of the output (30) of a sensor, for example, temperature sensor (14) in duct (8). The controller (23) reads the output (30) from sensor (14), which indicates the temperature in duct (8). For illustrative purposes this sensor will be assumed to be a solid-state sensor of the kind having an output voltage which varies directly with sensor temperature between 0, indicating no temperature reading (or a temperature below an inherent limitation of the sensor), to an upper voltage limit, usually equal to the supply voltage. Other temperature sensors could be used for this example within the teaching of the invention, such as those solid state sensors producing a variable current proportional to temperature, or traditional thermistors which change resistance with temperature.

In this illustrative example, the blower (9) causes air flow in duct (12), which passes over heater (13). Increasing the air flow in duct (12) will result in more flow over the heater (13), and thus a higher temperature in duct (8) recirculating air from the hopper (1). We will assume that it is desired to regulate this temperature within specific operating limits. On the graph, an upper voltage limit of $V_H$ indicates an upper temperature above which the temperature in duct (8) should not go, and a lower voltage limit of $V_L$ is chosen to indicate a temperature below which it is not desirable to operate.

The power supplied to a motor, for example the motor for blower (9), is line (31) on the graph, switched by controller (23) from on (i.e. full motor power supply) to off (i.e. no power supplied to the motor). The motor RPM (32) increases when the power is on, and decreases when it is off, but the actual value of the motor RPM (32) is not measured or considered by the controller (23).

Referring to the graph of FIG. 2, at the beginning of the graph, denoted as time $t_0$, the power (31) is on, and the motor RPM (32) is increasing. As the motor speeds up, the temperature in duct (8) increases, although the relationship between fan speed and temperature is not necessarily directly correlated, since other factors will also influence temperature.

The controller (23) reads the temperature by monitoring the output (30) of sensor (14). At time $t_1$, the sensor reading approaches or exceeds upper bound $V_H$, and the controller interrupts (turns off) the power (31). The motor RPM (32) begins to decline as the fan coasts down toward (but not all the way to) a stop (0% speed). Temperature begins to decline as well, and the sensor reading (30) reduces toward the lower bound $V_L$. At time $t_2$, the sensor output (30) declines below $V_L$, and the controller (23) turns on the power (31) once more.

The process repeats as the motor RPM (32) once again speeds up (toward, but preferably not to, 100% of its normal speed), and temperature read by the sensor output (30) increases back to $V_H$ by time $t_3$. Accordingly the controller (23) turns the power (31) off, and the motor RPM (32) and sensor output (30) decline again.

Therefore, while the method of the invention is operating, the motor changes its speed continuously. It will be recognized, however, that if the output is needed at maximum to maintain a parameter the motor will run longer periods. Also, a dryer might delay starting the method of the invention for a chosen period after startup to allow the system to operate continuously at maximum capacity.

The controller (23) will also be timing the amount of time that the power is interrupted, starting when the motor power is turned off. If the power-off time exceeds a selected duration D, empirically chosen for the specific motor/load combination to be shorter than the time which would allow the motor to coast to a complete stop, the power (31) will be turned back on regardless of the temperature indication (30). This is shown in the graph of FIG. 2, with the timer started at power-off times $t_1$ and $t_3$.

In the first instance, the temperature sensor output (30) declines below $V_L$ at time $t_2$ before the expiration of duration D, so the motor power (31) is turned on at $t_2$ to keep the temperature reading above $V_L$.

In the second instance, however, the timer is started at $t_3$ and duration D ends at $t_4$—before the temperature sensor output (30) has declined below $V_L$. The controller therefore turns the motor power (31) back on to keep the motor (9) from stopping, regardless of the temperature reading. The temperature reading (30), having never quite reached $V_L$, increases once again toward $V_H$, and the method continues.

Figure 3:
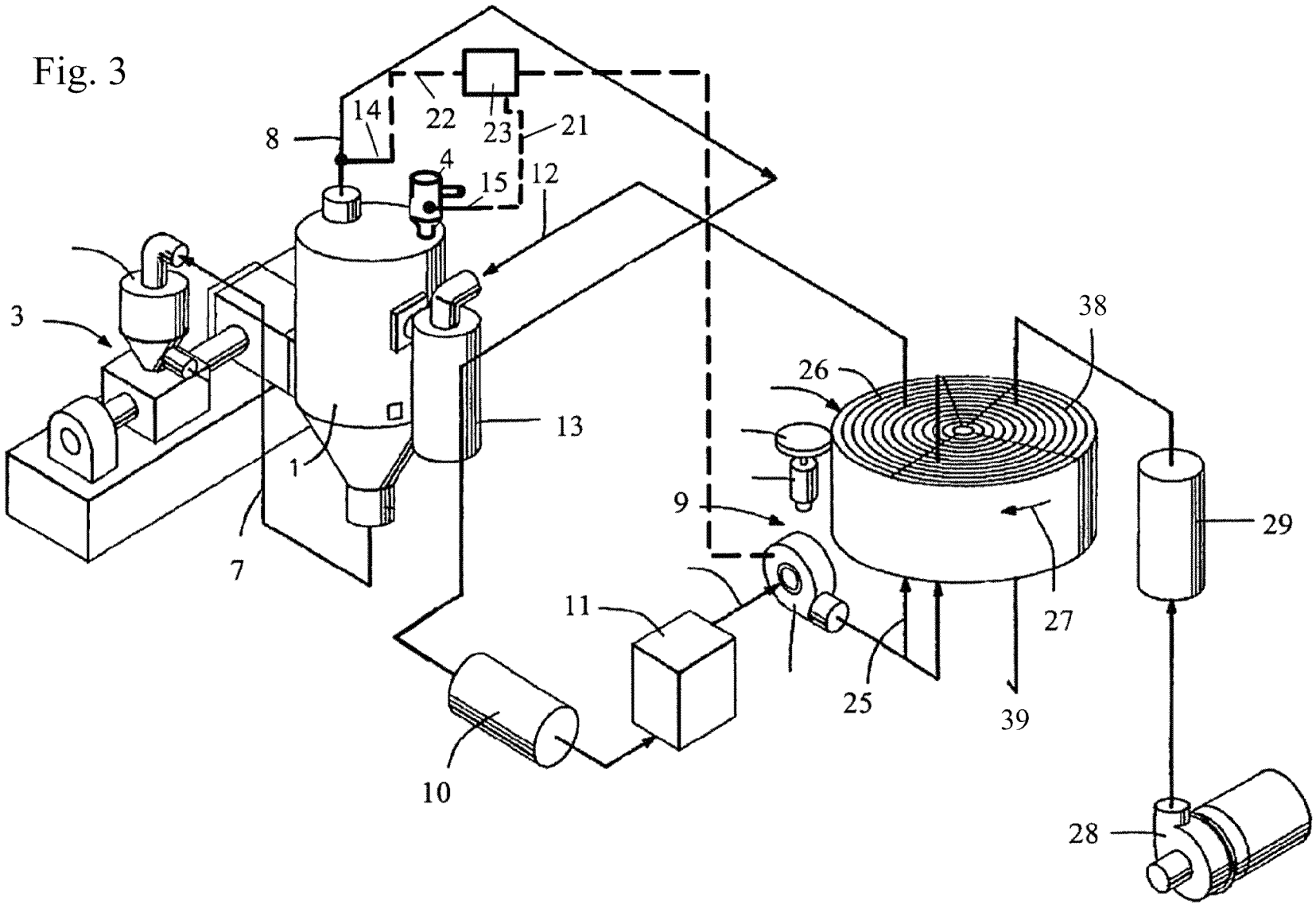
FIG. 3 shows another embodiment of a dryer for use with the invention, of the kind using a rotor and dessicant.

It will be understood that while the example is described in terms of controlling the a specific blower to control temperature in a specific duct, the method is equally applicable to controlling the other blowers in dryers, or the rotation motor in rotary dryers of the kind shown in FIG. 3, in response to sensor readings in other places.

Also, while the example shows control of the motor speed (32) in response to temperature readings (30) which vary in the same direction (increased motor speed increases temperature, if not on a strict one-for-one basis), it is entirely possible that the parameter being sensed by the sensor (or the voltage, resistance or current output of the particular sensor chosen) might be inversely proportional to the motor speed. For example, increased motor speed in a cooling fan motor could result in decreased temperature (33) in a dryer component being cooled by the cooling fan. Or, a particular sensor might have a higher output voltage at lower temperature and vice versa. In such instances the definitions of upper and lower set points on the sensor might be reversed, but the method remains the same—the motor power is interrupted when a sensed value (other than motor speed) reaches a set point, and motor power is resumed at the first to occur of the sensed value reaching another set point or a timer duration elapsing.

The method can be used to control multiple motors simultaneously in response to a single sensor, in which case the maximum power-off duration D would have to be chosen based upon the first motor to stop rotating. Alternatively, the method could control multiple motors individually in response to readings from multiple sensors.

The process in accordance with the invention is especially useful for controlling of blowers in adsorption dryers as the heating of the air stream created by the blower is reduced to a minimum. This improves the dew point of the air stream created by the effect of the adsorption media, through which the air stream is flowing.

The method of the invention is also advantageous in driving the rotors containing the adsorption material in honeycomb rotary dryers as shown in FIG. 3, especially if the dryers use Silica Gel, as this adsorbent works only at low temperatures. This reduction of the heating of the dry air allows the use of Silica Gel instead of Molecular Sieve, as described in the U.S. Pat. No. 6,951,065.

Figure 4:
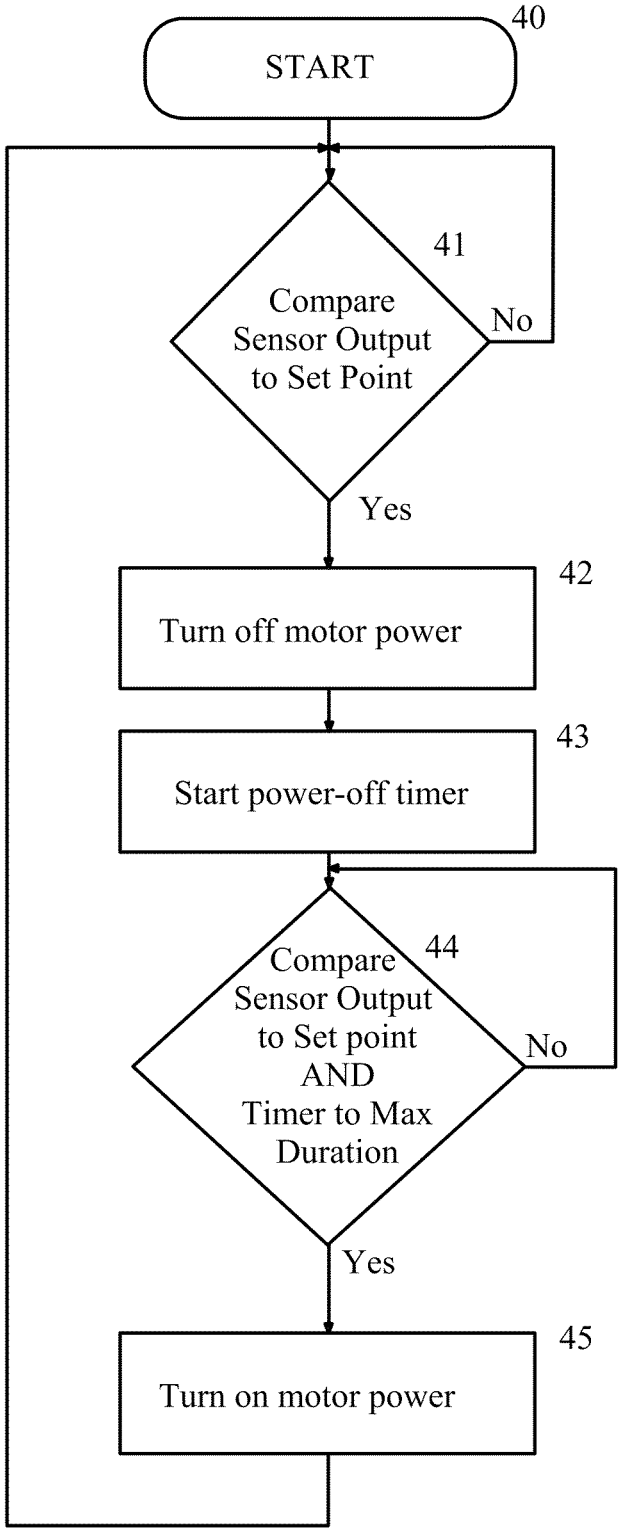
FIG. 4 shows a flowchart of the method of the invention.

FIG. 4 shows a flowchart of the method of the invention, described as follows:

Step 40—The method begins.

Step 41—Compare a sensor output (30) measuring a parameter other than motor RPM to a first set point, here given as upper bound $V_H$. If the sensor output (30) does not meet (i.e is less than or equal to) the upper bound (or greater than or equal to a lower bound, if the parameter or output is inversely related to motor speed) (shown in the flowchart as "no", meaning the set point is not met), then repeat this step 41.

Step 42—Turn motor power off

Step 43—Start the power-off timer.

Step 44—Compare the sensor output (30) to a second set point, here given as the lower bound $V_L$ and the power-off timer to a time duration D. Duration D is set to a duration shorter than that which would result in the motor stopping. If the sensor output (30) does not meet (i.e. is greater than or equal to) the lower bound (or less than or equal to an upper bound, if the parameter or output is inversely related to motor speed), and the power-off timer is less than D, then repeat this step 44 (shown in the flowchart as "no", meaning neither condition is met).

Step 45—Turn the motor power on, and repeat the method from step 41.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of controlling motor speed of at least one motor in a dryer by interrupting motor power powering the at least one motor in response to a sensor output related to a parameter other than motor speed which varies with motor speed, comprising the steps of:

a) compare the sensor output to a first set point; if the sensor output does not meet the first set point, then repeat this step (a);

b) if the sensor output met the first set point in step (a), turn motor power off;

c) start a power-off timer;

d) compare the sensor output to a second set point and the power-off timer elapsed time to a selected time duration; if the sensor output does not meet the second set point and the power-off timer is less than the time duration, then repeat this step (d); and e) if either the sensor output met the second set point or the power-off timer exceeded the duration in step (d), turn the motor power on, and repeat the method from step (a).

2. The method of claim 1, in which the time duration of step (d) is set to a duration shorter than that which would result in the motor stopping.

3. The method of claim 1, in which the parameter varies directly with motor speed, and:

the first set point is an upper bound and the sensor output meets the set point in step (a) if the sensor output is greater than or equal to the upper bound; and the second set point is a lower bound and the sensor output meets the set point in step (d) if the sensor output is less than or equal to the lower bound.

4. The method of claim 1, in which the parameter varies inversely with motor speed, and:

the first set point is a lower bound and the sensor output meets the set point in step (a) if the sensor output is less than or equal to the lower bound; and the second set point is an upper bound and the sensor output meets the set point in step (d) if the sensor output is greater than or equal to the upper bound.

5. The method of claim 1, in which more than one motor is powered by the motor power, such that a plurality of motors are controlled simultaneously by the method.

6. The method of claim 1, in which at least one of the at least one motor is a fan motor.

7. The method of claim 1, in which the dryer is an adsorption dryer which uses a honeycomb rotor containing the adsorption medium, and at least one of the at least one motor is a motor powering the rotor.

8. The method of claim 1 in which the parameter is temperature in an air duct of the dryer.

9. The method of claim 1 in which the parameter is air flow in a duct of the dryer.

10. The method of claim 1 in which the motor power is turned on and off by a triac.

11. A dryer comprising:

at least one motor;

at least one sensor having an output related to a parameter other than motor speed which varies with motor speed; and a controller comprising at least one input coupled to an output of the sensor, a power-off timer, and an output supplying motor power to the at least one motor; in which the controller operates by controlling motor speed of the at least one motor by interrupting the motor power on the output powering the at least one motor in response to the input coupled to the sensor output, the controller controlling the speed of the motor by a method comprising the steps of:

a) compare the sensor output to a first set point; if the sensor output does not meet the first set point, then repeat this step (a);

b) if the sensor output met the first set point in step (a), turn motor power off;

c) start a power-off timer;

d) compare the sensor output to a second set point and the power-off timer elapsed time to a selected time duration; if the sensor output does not meet the second set point and the power-off timer is less than the time duration, then repeat this step (d); and e) if either the sensor output met the second set point or the power-off timer exceeded the duration in step (d), turn the motor power on, and repeat the method from step (a).

12. The dryer of claim 11, in which the time duration of step (d) is set to a duration shorter than that which would result in the motor stopping.

13. The dryer of claim 11, in which the parameter varies directly with motor speed, and:

the first set point is an upper bound and the sensor output meets the set point in step (a) if the sensor output is greater than or equal to the upper bound; and the second set point is a lower bound and the sensor output meets the set point in step (d) if the sensor output is less than or equal to the lower bound.

14. The dryer of claim 11, in which the parameter varies inversely with motor speed, and:

the first set point is a lower bound and the sensor output meets the set point in step (a) if the sensor output is less than or equal to the lower bound; and the second set point is an upper bound and the sensor output meets the set point in step (d) if the sensor output is greater than or equal to the upper bound.

15. The dryer of claim 11, in which more than one motor is powered by the motor power, such that a plurality of motors are controlled simultaneously by the method.

16. The dryer of claim 11, in which at least one of the at least one motor is a fan motor.

17. The dryer of claim 11, in which the dryer is an adsorption dryer which uses a honeycomb rotor containing the adsorption medium, and at least one of the at least one motor is a motor powering the rotor.

18. The dryer of claim 11 in which the parameter is temperature in an air duct of the dryer.

19. The dryer of claim 11 in which the parameter is air flow in a duct of the dryer.

20. The dryer of claim 11 in which the motor power is turned on and off by a triac.

* * * * *